United States Patent [19]

Harashima

[11] 4,030,632

[45] June 21, 1977

[54] FOOD VENDING MACHINE WITH COOKING APPARATUS

[75] Inventor: Ikuo Harashima, Tsesaki, Japan

[73] Assignee: Sankyo Electric Company, Limited, Isesaki, Japan

[22] Filed: May 28, 1976

[21] Appl. No.: 690,923

[30] Foreign Application Priority Data

| | | |
|---|---|---|
| May 29, 1975 | Japan | 50-71330[U] |
| Sept. 8, 1975 | Japan | 50-109175 |
| Oct. 3, 1975 | Japan | 50-136173[U] |
| Dec. 1, 1975 | Japan | 50-162343[U] |
| Dec. 10, 1975 | Japan | 50-167078[U] |

[52] U.S. Cl. ..... 221/150 A; 222/39; 222/70; 221/15; 194/2; 194/3

[51] Int. Cl.[2] ..... G07F 9/10

[58] Field of Search ..... 221/2, 3, 15, 21, 150 HC, 221/150 A; 194/2, 3, 5, 10, 13; 99/325, 352, 357; 141/104, 362; 222/129.4, 129.3, 23, 39, 70

[56] References Cited

UNITED STATES PATENTS

| | | | |
|---|---|---|---|
| 3,313,450 | 4/1967 | Erickson | 194/13 X |
| 3,381,605 | 5/1968 | Smith | 221/150 HC X |
| 3,425,339 | 2/1969 | Fleischman et al. | 99/357 |
| 3,928,045 | 12/1975 | Tsunoda et al. | 221/150 HC X |

*Primary Examiner*—Stanley H. Tollberg

*Assistant Examiner*—Joseph J. Rolla

*Attorney, Agent, or Firm*—Hopgood, Calimafde, Kalil, Blaustein & Lieberman

[57] ABSTRACT

A vending machine for selling foods contained in cups (cup-foods) is provided with an apparatus for cooking the foods in the cup. The cooking apparatus comprises a cooking chamber and a hot water feeding device. A door of the cooking chamber may be opened only during a predetermined time period after each cup food is sold and is locked during other time periods. The hot water feeding device is operable only during a time period when the door of the cooking chamber is closed during a predetermined time period after the each cup food is sold. The hot water feeding device is operated by the operation of a cook selection button to pour hot water into the cup which is put in the cooking chamber. The predetermined time period during which the door may be opened is determined by a timer and the time period of the operation of the hot water feeding device, which is shorter than this predetermined time period is determined by another timer. Devices, which are activated prior to the operation of the hot water feeding device are energized by the operation of the cook selection button, and, thereafter, the hot water feeding device is operated by the detection of the completion of the operation of these previously energized devices. A mechanism for guiding the cup in the cooking chamber to place it at the correct position may be provided.

18 Claims, 18 Drawing Figures

FOOD VENDING MACHINE WITH COOKING APPARATUS

BACKGROUND OF THE INVENTION

This invention relates to automatic vending machines and, in particular, to machines for vending foods which are provided with apparatus for cooking the food which has been just sold.

Recently, processed and dried foodstuffs contained in cups have been produced and commercially sold which are readily cooked by pouring boiled water thereon, if necessary, followed by mixing. Such foods include for example, processed and dried noodles, rices, curry and rice, stew and so on which are contained in cups.

In selling cups containing such processed foodstuffs (which will be referred as "cup-foods" hereinafter), automatic vending machines may be employed. But if the employed machine is one having only a vending function without any provision for applying boiled water to the food, a purchaser of the cup-foods cannot eat them instantly.

A vending machine has been used for selling cup-foods, which is provided with a cooking apparatus, so that a purchaser can instantly cook the vended cup-food by the use of the cooking apparatus and eat it.

Such cooking apparatus comprises a cooking chamber with a door and a hot water, or boiled water, feeding device, which is arranged in a housing of the vending machine.

The purchaser opens the door of the cooking chamber to put the purchased cup-foods into the chamber, and then closes the door. Thereafter, he pushes a cooking button which is provided to control the feeding of single cup quantities of boiled water. Thus boiled water is poured into the cup within the cooking chamber to cook the cup-foods.

In the known cooking apparatus used in the vending machine, the door of the cooking chamber may be opened at any time, and boiled water is poured into the cooking chamber at any time when the cooking button is pushed. Therefore, the cooking apparatus can be tampered with causing the introduction of dirt or foreign matter into the interior of the cooking chamber so that it cannot be maintained clean. In case the preserved boiled water is wasted by pouring it into the chamber at the wrong times, the cooking apparatus becomes inoperable.

Moreover, since boiled water could be poured into the cooking chamber even when the door is open, the user may be scalded with resulting serious injury.

SUMMARY OF THE INVENTION

An object of this invention is to provide a vending machine with a cooking apparatus which is operable only during a predetermined time period after each individual cup-food is sold by the vending machine.

Another object of this invention is to provide a cup-foods vending machine with a cooking apparatus including a cooking chamber with a door and a boiled water feeding device wherein the door may be opened only during a predetermined time period after each individual cup-food is sold and wherein the boiled water feeding device is operable only when the door is closed.

A further object of this invention is to provide a cup-foods vending machine with a cooking apparatus including a cooking chamber and a cooking device wherein the cooking device is operable only during a period when a cup-food is place in the cooking chamber at a predetermined position.

A vending machine according to this invention includes a cooking apparatus which comprises a cooking chamber, a door for closing an opening in the cooking chamber, means for locking the door, cooking means for cooking foods within the cooking chamber, manually operated activating means for starting the cooking means, means for detecting a signal which is generated at a time when an item is sold or discharged from the vending machine, first timer means which is started in response to the detection of the PRM discharging signal and which operates for a first predetermined time period to release the door locking means and to make the cooking means operable, and second timer means which is started by operating the manually activating means during the time period when the first timer means is in operation and which operates during a second predetermined time period shorter than the first predetermined time period to operate the cooking device, whereby the opening of the door of the cooking chamber and the operation of the cooking device are each possible only during predetermined time periods after an item has been sold.

The door of the cooking chamber may be locked during the period when the cooking means is in operation by inhibiting the release of the locking means in response to the output of the second timer means.

A mechanism for locating a food container in the cooking chamber at the correct position may be provided in the cooking chamber. Means for detecting whether the container has been placed at the correct position may be provided to make the cooking means inoperable when the container is not at the correct position.

The cooking apparatus may include means, to ensure that the food in the container is in condition to be cooked by the cooking means, and/or means for detecting whether the food is cookable or not, for example, means for perforating a cover of the container, means for transferring the container to a cooking position, means for detecting whether the cover is effectively removed and so on. Such means are activated by the operation of the manually operated means for starting the cooking means and, thereafter, the second timer means is operated to operate the cooking means after completion of these previously activated functions.

Further objects and features of this invention will be understood from following descriptions which disclose embodiments of this invention with reference to the annexed drawings.

DETAILED DESCRIPTION OF PREFERRED EMBODIMENTS

Figure 1:
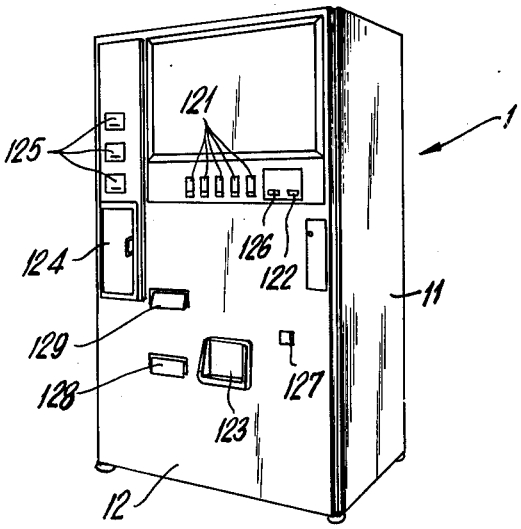
FIG. 1 is a perspective view of the exterior of an embodiment of a vending machine according to this invention.

Referring to FIG. 1 which shows a perspective view of an embodiment of this invention, the vending machine 1 comprises a housing 11 and a front door 12 of the housing. The front door 12 is pivotally fixed to the housing 11 at one end and is locked to the housing at the opposite end, so that the door 12 may be opened by releasing the lock.

On the front door 12, item selection buttons 121 (five buttons are shown), a coin deposit opening 122, a goods dispersing opening 123, a door 124 for accessing a cooking chamber, cook selection buttons 125 (three buttons are shown), a coin repaying lever 126, a coin repaying opening 127, a spoon dispenser opening 128, and a fork dispenser opening 129 are provided, as shown in the drawing.

The number of item selection buttons 121, and the number of cook selection buttons 125 may be varied accordingly to kinds of goods to be sold in the machine.

Moreover the spoon dispenser opening 128 and the fork dispenser opening 129 are provided if needed for the kind of goods to be sold in the machine.

Figure 2:
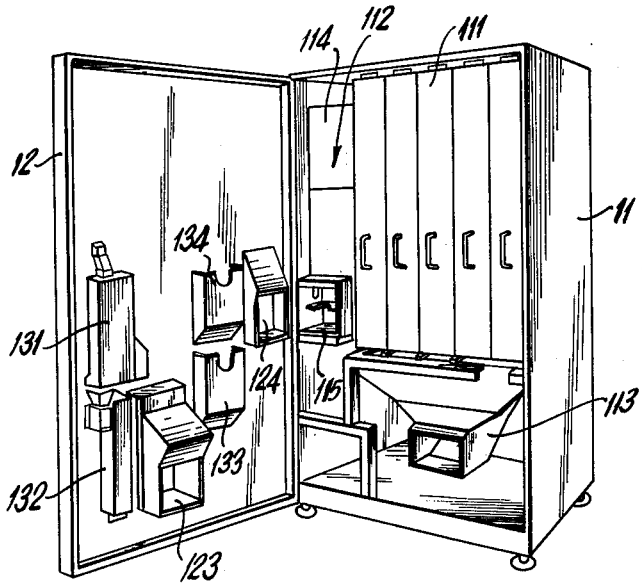
FIG. 2 is a perspective view of the embodiment in FIG. 1, with a door of a machine housing being open, showing the interior

Referring to FIG. 2 which shows a perspective view of the embodiment with the front door 12 being open, shelf units 111 (five units are shown) for containing goods therein, a cooking apparatus 112 and an item discharge guide 113 are mounted within a housing 11.

The cooking apparatus 112 comprises a hot or boiled water feeding device 114, a cooking chamber 115 and other mechanisms which will be described hereinafter.

On the rear side of the front door 12, a coin detecting mechanism 131, a coin containing box 132 a spoon containing box 133 and a fork containing box 134 are mounted.

Referring to FIGS. 1 and 2, when a purchaser deposites a coin or coins into the coin deposited opening 122 and, then pushes an item selection button 121, one item, or a cup-food, is discharged to the item discharge guide 113 from a corresponding shelf unit 111 by means of a control circuit and an item discharging mechanism (which are not shown). Thus, the purchaser can obtain a desired cup-food from the item dispenser opening 123 which communicates with the item discharge guide 113.

Because the control circuit, the item discharging mechanism, the coin detecting mechanism 131 and other features for automatically vending goods are known in prior art, and because this invention is not directed to such vending apparatus, further description of these features will be omitted for the simplification of the description.

Figure 3:
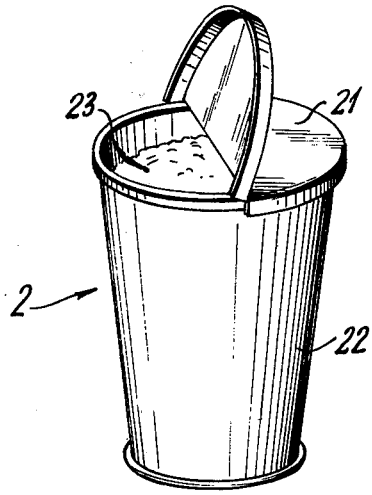
FIG. 3 is a perspective view of a cup-food which is sold in the vending machine in FIG. 1.

After removing the item from discharge guide 113 the purchaser takes off a cover 21 of the cup-food 2, as shown in FIG. 3, and, then, puts it in the cooking chamber 115 after opening the door 124. Then he pushes a cook selection button 125. Boiled water is then fed into the cup 22 from feed device 114 and poured on the food 23 in the cup 22. The purchaser can eat the prepared cup-food by the use of spoon or a fork which is obtained respectively through openings 128 or 129.

In a known cooking apparatus, the door 124 for the cooking chamber 115 may be opened at any time. Therefore, the cooking chamber 115 may be tampered with. Moreover, the hot water feeding device 114 may be operated at any time by pushing any one of cook selection buttons 125 so that the boiled water is wasted and could cause injury from scalding.

According to this invention, the door 124 of the cooking chamber 115 is normally locked and may be opened only during a first predetermined time period after each one item is discharged from a shelf unit 111 by the operation of the vending apparatus. Moreover, the hot water feeding device 114 is operable during this first predetermined time period only when the door 124 is closed.

Figure 4A:
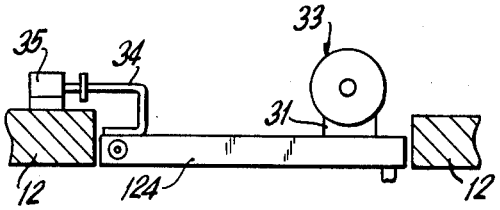
FIG. 4*a* is a plan view of a door of a cooking chamber with locking means.
Figure 4B:
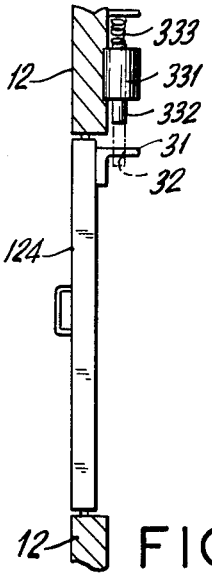
FIG. 4*b* is a side view of the door in FIG. 4*a*.

In FIGS. 4*a* and 4*b*, the door 124 for the cooking chamber 115 is schematically shown with a door locking mechanism and means for detecting whether the door 124 is open or closed. The door 124 is provided with a locking arm 31 which is fixed to the rear side of the door. The locking arm 31 is formed with a hole 32. On the front door 12, a solenoid-plunger device 33 is fixed. The solenoid plunger device 33 is so located that when a solenoid 331 is not energized a plunger 332 is inserted into the hole 32 of the locking arm 31 by an effective force generated by a spring 333 to lock the door 124 in a closed condition. When the solenoid 331 is energized, the plunger 332 is retracted into the solenoid 331 against the spring 333 and moves out of the hole 32 of the locking arm 31 as shown in FIG. 4*b* so that the door 124 may be opened.

Figure 4C:
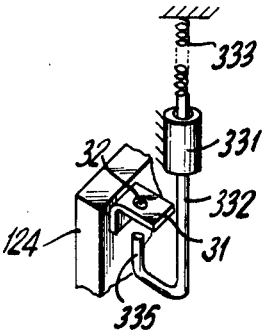
FIG. 4*c* illustrates another locking means of the door of the cooking chamber, FIG. 5 schematically shows a hot water feeding device.

Alternatively the door locking mechanism may be arranged as shown in FIG. 4*c*. Namely, the end of the plunger 332 is bent into a U-shape and the plunger 332 extends over the locking arm 31 so that the bent end 335 faces the opposite side of the locking arm 31. When the solenoid 331 is energized, the plunger 332 is retracted against the spring 333 so that the bent end 335 is inserted into a hole 32 of the locking arm 31. Thus the door 124 is locked.

The door is also provided with another arm 34 on the rear side. On the front door 12, a microswitch 35 is so mounted that the microswitch 35 is closed by the arm 34 when the door 124 is closed. The microswitch 35 is switched off when the door 124 is open.

Figure 5:
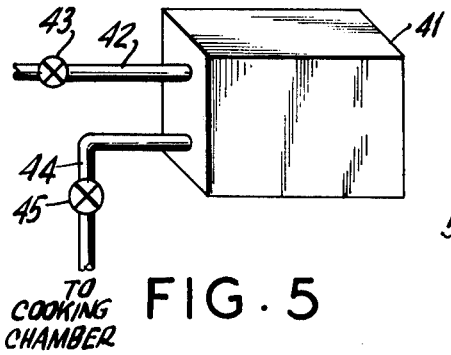

Referring to FIG. 5, the hot water feeding device 114 comprises a water tank 41 with a heater element (not shown) which heats water in the tank. The water tank is connected to a water supply (not shown) through an inlet pipe 42 and a valve 43 such as an electro-magnetic valve, or a solenoid valve. An outlet pipe 44 is led out from the tank 41 to the cooking chamber 115 (FIG. 2) through an electro-magnetic valve 45.

Figure 6:
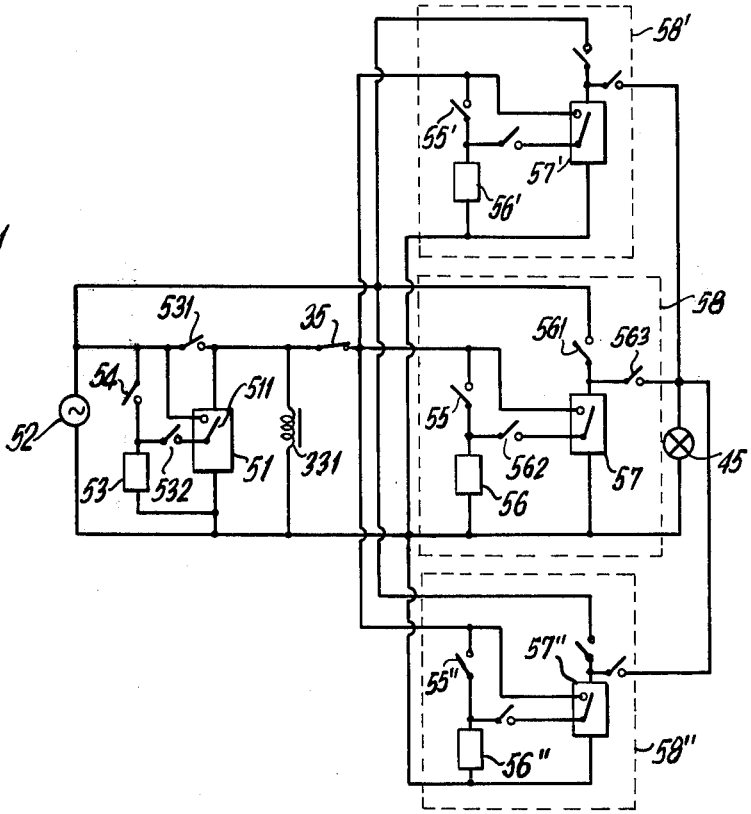
FIG. 6 is a circuit diagram of an embodiment a control circuit of a cooking apparatus.

Referring to FIG. 6, in which an electrical control circuit is shown, a timer 51 is connected to a power source 52 through a make contact 531 of a relay 53. The relay 53 is also connected to the power source through a relay contact 54. The relay contact 54 is a make contact of a relay (not shown) which is connected to a vending control circuit of the vending apparatus to detect a vending signal which is generated when an item is dispensed or sold.

The series circuit of the relay contact 54 and the relay 53 is connected in parallel with the series circuit of the make contact 531 and the timer 51. Another make contact 532 of the relay 53 is connected to the relay contact 54 in parallel through a make contact 511 of the timer 51.

When the vending signal is present the relay contact 54 closes the relay 53 is then energized so that the timer 51 operates. Thus the timer 51 is maintained in operation through the make contact 532 of the relay 53 and the make contact 511 of the timer 51 during a first time period defined by the timer 51.

The solenoid 331 of the solenoid plunger 33 (FIGS. 4*a* and 4*b*) is connected in parallel with the timer 51. Therefore the solenoid 331 is energized through the make contact 531 of the relay 53 during the time period when the timer 51 operates. Thus the door 124 (FIG. 1) may be opened during the time period defined by the timer 51 after a cup-food 2 (FIG. 3) is sold by the vending machine, so that the cup-food 2 can be put into the cooking chamber 115 (FIG. 2).

If the door locking mechanism in FIG. 4*c* is used, the solenoid 331 in FIG. 6 should be replaced by a relay which has a break contact connected between the solenoid 331 in FIG. 4*c* and a power source.

As a result, when the timer 51 is in operation, the plunger 332 of the solenoid 331 in FIG. 4*c* moves out of hole 32 in locking arm 31 and the door 124 may be opened.

A switch contact 55 of a cook selection button 125 (FIG. 1) is connected in series with a relay 56, and the series circuit of the contact 55 and the relay 56 is connected to the timer 51 through a contact of the microswitch 35 (FIG. 4*a*) which is closed by closing door 124.

A second timer 57 is connected to the power source 52 through a make contact 561 of the relay 56. Another make contact 562 is connected in parallel with the switch contact 55 through a make contact of the timer 57. The outlet electro-magnetic valve 45 for tank 41 (FIG. 5) is connected to the timer 57.

When the timer 51 is in operation, the second may be timer 57 operated by pushing the cook selection button 125 during time periods when the door 124 of the cooking chamber 115 is closed. The valve 45 is connected to power source 52 through make contact 563 of relay 56 and is opened during the timer period defined by the timer 57, so that hot water is poured into the cup 22 (FIG. 3) which is put in the cooking chamber 115.

In FIG. 6, two circuit blocks 58′ and 58″ include the same elements and are arranged similarly to the circuit block 58 which comprised the switch contact 55, the relay 56 and the timer 57. The circuit blocks 58, 58′ and 58″ are connected in parallel with one another. Similar parts in blocks 58′ and 58″ are indicated by same reference numerals with a prime (′) and double primes (″), respectively, such as the switch contact 55, the relay 56 and the timer 57 in the block 58.

The switch contacts 55, 55′ and 55″ correspond to the three cook selection buttons 125 in FIG. 1, respectively.

The timers 57, 57′ and 57″ may differ from one another in the operating time so that different quantities of hot water are fed from the outlet pipe 44 (FIG. 5) by pushing different cook selection buttons 125.

The number of the cook selection buttons 125 and, therefore, the number of the circuit blocks including the switch contacts 55, 55′ and 55″ of the cook selection buttons 125 such as the blocks 58, 58′ and 58″ in FIG. 6, may be optionally determined.

The operating time of the timer 51 must be determined such that it is longer than the operating time of any one of the other timers 57, 57′ and 57″, so that the door 124 may be opened during a long enough time period that a cup-food may be put into the cooking chamber and taken out after any one of the time intervals of the timers 57, 57′ and 57″.

According to the arrangement shown in FIGS. 4*a*–6, it will be understood that the door 124 of the cooking chamber 115 may be opened only during first predetermined time period defined by timer 51 after each individual cup-food is sold in the vending machine and that the hot water feeding device is operable only when the door 124 of the cooking chamber is closed and during a second predetermined time period defined by one of timers 57, 57′ and 57″. Therefore, the above described disadvantages in known apparatus are overcome.

It is not desired that the hot water be fed from the outlet pipe 44 of the tank 41 when no cup 22 is in the cooking chamber. Furthermore, it is not desired that the door 124 of the cooking chamber be opened while the hot water is being discharged. In order to prevent the occurrence of these undesirable conditions, a second microswitch may be provided in the cooking chamber 115 to detect the presence of the cup, a contact of this microswitch is connected in series with the microswitch 35 in FIG. 6, and the relay 56 in FIG. 6 may be provided with a break contact which is connected in series with the solenoid 331, as is shown in the following embodiment of FIG. 10.

Figure 6A:
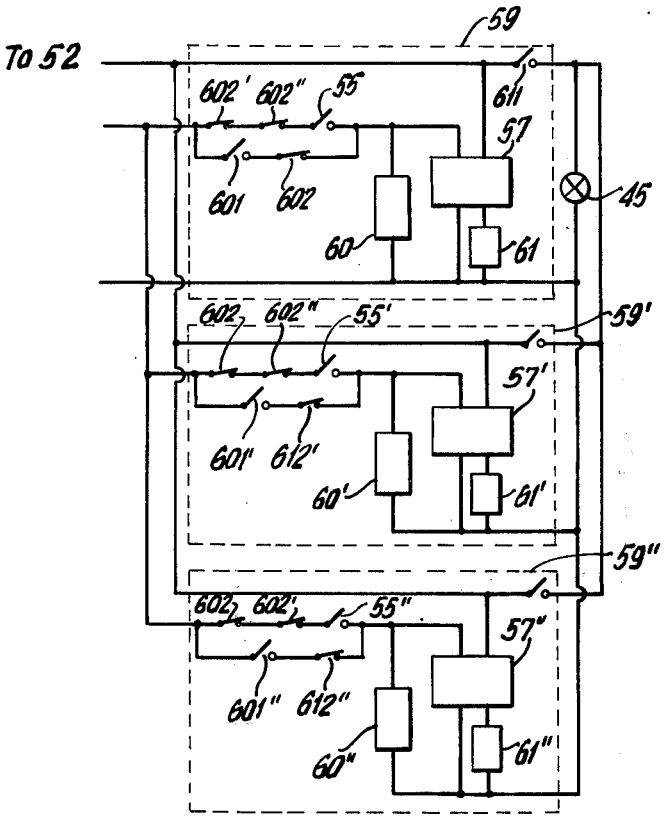
FIG. 6*a* is a circuit diagram of a main part of a modified control circuit.

FIG. 6*a* shows a modification of the circuit blocks 58, 58′ and 58″ in FIG. 6. The modification is shown in three circuit blocks 59, 59′ and 59″.

The circuit block 59 comprises a relay 60 which is energized by turning on the switch contact 55 of a cook selection button, and is maintained in operation through a make contact 601 of the relay 60. The timer 57 is energized through the make contact 601 and operates during a predetermined time period to energize a relay 61 during the operating time period.

A make contact 611 of the relay 61 is connected between the power source 52 and the electro-magnetic valve 45, so that the valve 45 is opened to discharge hot water from the port 46 of the pipe 44 only during the predetermined operating time of the timer 57.

A break contact 612 of relay 61 is connected in series with the make contact 601 of the relay 60, so that when the relay 61 is operated, the relay 60 is de-energized and the power feeding to the timer 57 is stopped.

It should be noted however that the timer 57 is arranged to maintain its operation after being started for a predetermined period so that valve 45 continues open for this period.

The other circuit blocks 59' and 59'' are similarly arranged as the above described circuit block 59 and similar parts are indicated by same numerals with a prime (') and double primes ('), respectively.

Relays 60, 60' and 60'' have additional break contacts 602, 602' and 602'' respectively. The break contacts of the other two relays, for example 60' and 60'', are connected in series with a switch contact 55 which is included in the circuit block 59 which includes the third relay 60 so that, when either of switch contacts 55' and 55'' is operated, the circuit block 59 can not be operated even by closing the switch contact 55.

Similarly, switch contacts 55' and 55'' are connected in series with break contacts 602 and 602'', and 602 and 602', respectively.

Upon the solenoid valve 45 being opened, hot water will be poured into the cup which is in the cooking chamber. Therefore the cup must be placed in the cooking chamber such that the open end of the cup is beneath the output port 46 of the outlet pipe 44. To this end, an indexing mark or a depression may be formed in the bottom of the cooking chamber but it can still occur that the cup is not placed at the position indicated by the mark.

Figure 7:
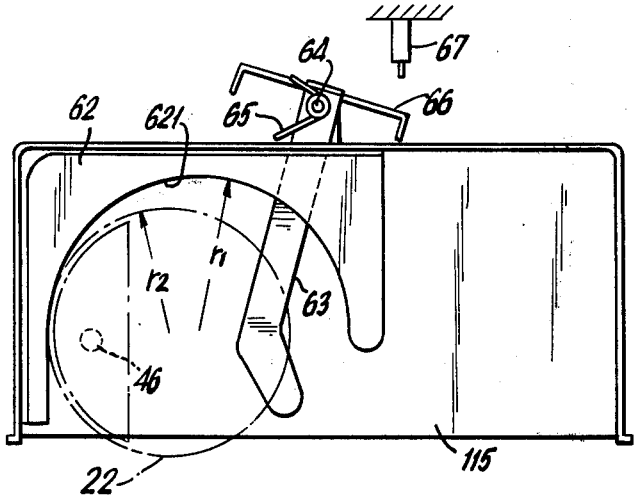
FIG. 7 is a sectional view of the cooking chamber.

Referring to FIG. 7, in which the cooking chamber 115 is shown, the cooking chamber 115 is formed as a box with an open front end. In the chamber 115, a cup guide plate 62 is fixed to inner wall of the chamber.

The cup guide plate 62 (which is also shown in FIG. 2) is formed with an arcuate guide edge 621 of a radius $r_1$ larger than the maximum radius $r_2$ of the cup 22. The height of the guide edge 621 from the bottom in the chamber may be determined such that it is shorter than, but nearly equal to, the height of the cup 22.

A lever 63 is pivotally fixed to the rear wall of the chamber about a pivot 64 so that the lever 63 may be rotated around the pivot 64 in a horizontal plane at a height nearly equal to, but lower than, the guide edge 621. The lever 63 is biased by means of a spring 65 so that one end of the lever 63 in the chamber may approach the guide edge 621. The other end of the lever 63, which is shown to be out of the chamber, is provided with a stopper 66 which prevents the lever 63 from over rotating since it contacts the rear wall of the chamber. Therefore, when the cup 22 is inserted between the guide edge 621 and the lever 63, the cup 22 is located at a constant position, as shown by the chain line of FIG. 7 through the guiding function of the guide edge 621 in cooperation with the level 63.

A microswitch 67 may be fixedly disposed so that the stopper 66 closes the microswitch 67 when a cup 22 is inserted between the guide edge 621 and the lever 63, is located at the correct and constant position. The microswitch 67 may then be used as a means for detecting that the cup is put in the chamber 115 at the correct position.

Hot water is then poured into the cup without failure, if the output port 46 (shown by a dotted line) of the outlet pipe 44 (FIG. 5) is disposed correspondingly above the position at which the cup is located automatically as shown in FIG. 7.

Even if the cup 22 is put in the cooking chamber 115 at the correct position, hot water will not enter cup 22, if the cover 21 (FIG. 3) of the cup is not effectively removed. FIG. 3 illustrates the cover 21 being effectively removed.

Figure 8:
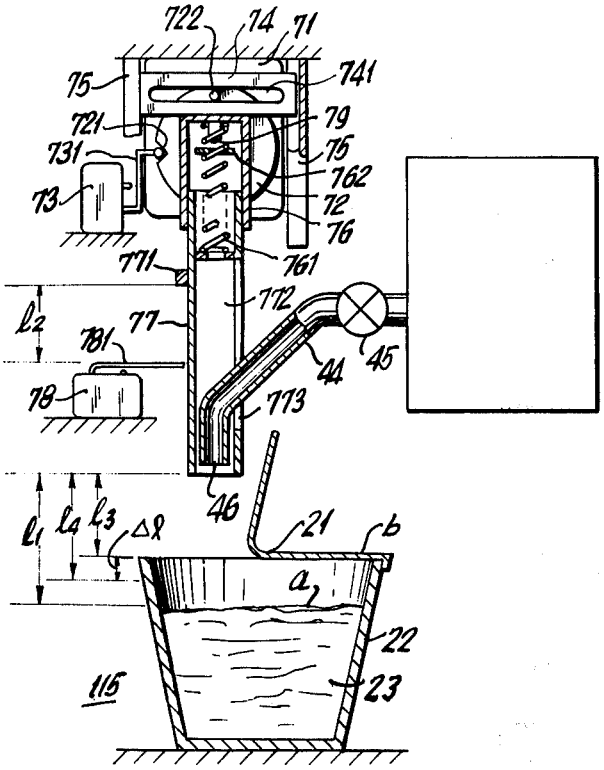
FIG. 8 is a sectional view of a device for detecting whether a cover of the cup-food is effectively removed or not.

FIG. 8 shows a sectional view of a mechanism for detecting whether the cover 21 of the cup 22 is effectively removed so that hot water may be poured into the cup 22 from the output port 46. The mechanism comprises an electric motor 71 and a circular cam plate 72 which is rotated by the motor 71.

The cam plate 72 is formed with a depression 721 at a position on the circumference of the annular cam surface thereof, and with an eccentric pin 722 at a point on the peripheral surface thereof at an angular position spaced 90° from the depression 721.

A microswitch 73 is so disposed that an operating lever 731 engages with, and follows, the cam surface of the cam plate 72. When the lever 731 of the microswitch 73 engages with the depression 721, the microswitch 73 is opened, and when the lever 731 follows the circumference of the cam surface of the cam plate 72, the microswitch 73 is closed.

A slider 74 is slidable mounted on opposed vertical guide rails 75, and is provided with a horizontally elongated slit 741 in which the pin 722 is slidably fitted. Thus, the slider 74 is moved downwardly and upwardly along the guide rails 75 by the rotation of the cam plate 72 when it is driven by the motor 71.

A cylindrical body 76 is fixed to the slider 74. In the cylindrical body 76, a detector rod 77 is inserted from a lower open end of the body 76 and is supported by the body 76 so that the rod 77 may not fall out of the cylindrical body 76. However, the rod 77 is slidable within the cylindrical body 76 and is downwardly urged by a spring 761 which is mounted within the cylindrical body 76.

Therefore, it will be noted that the cylindrical body 76 and the rod 77 are moved together with the motion of the slider 74.

On the outer surface of the detector rod 77, a projection 771 is provided to operate a microswitch 78. The microswitch 78 is so disposed that, when the detector rod 77 is moved to, or near to, the lowest position, an operating lever 781 engages with the projection 771 to close the microswitch 78.

The detector rod 77 is formed with a bore 772 and a vertically elongated opening 773 through which the outlet pipe 44 of tank 41 is introduced into the bore 772.

The above described mechanism is so disposed above the cooking chamber 115 that the detector rod 77 is movable upwardly and downwardly about the output port 46 within the bore 772. The output port 46 is fixedly disposed above the chamber 115 to face the cup 22 within the chamber 115.

A vertical space $l_1$ is provided between the upper surface *a* of the dried food 23 in the cup 22 within the chamber 115 and the lower end of the detector rod 77 which is at a highest position or a rest position, as shown in FIG. 8. This distance must not be smaller than the vertical distance $l_2$ between the lever 781 of the microswitch 78 and the projection 771 of the detector rod 77 when rod 77 is at the rest position, nor may it be smaller than the stroke of the slider 74.

The distance $l_2$ and the stroke of the slider 74 must be greater than the vertical space $l_3$ between the cover surface *b* of the cup 22 in the chamber 115 and the lower end of the detector rod 77 at the rest position. Thus the stroke of the detector rod 77 is $l_4$ which is equal to $l_3$ plus 1.

Accordingly, because the detector rod 77 can be lowered to the lowest position if the cover 21 of the cup is removed at least partially to permit hot water to pour into the cup, the microswitch 78 will be closed. But if the cover 21 is not effectively removed, the lower end of the detector rod 77 with engage the cover 21 so that the detector rod 77 is prevented from reaching its lowest position. Then the detector rod 77 is pushed into the body 76 against the spring 761 when the body 76 is further lowered. As a result, the microswitch 78 will not close during the complete revolution of the cam plate 72.

Thus, it is detected whether the cover 21 is effectively removed or not.

The microswitch 73 maintains the power feeding to the motor 71 during a complete revolution of the cam plate 72. Once the motor 71 is energized to rotate the cam plate 72, the microswitch 73 is closed by the lever 731 leaving depression 721 and engaging the cam surface of the cam plate 72 and is maintained closed until the operating lever 731 again engages with the depression 721.

In FIG. 8, another microswitch 79 is provided in the cylindrical body 76 for detecting that the detector rod 77 is prevented from further lowering.

When the detector rod 77 is pushed into the cylindrical body 76, the microswitch 79 is closed by an operating plate 762 fixed to the spring 761.

According to this embodiment, if the electro-magnetic valve 45 is energized when the microswitch 78 is opened, hot water is prevent from being discharged from the port 46 when the cover 21 of the cup 22 is not effectively removed. Furthermore, by the output of the microswitch 79, for example, an alarm would be operated.

Figure 9:
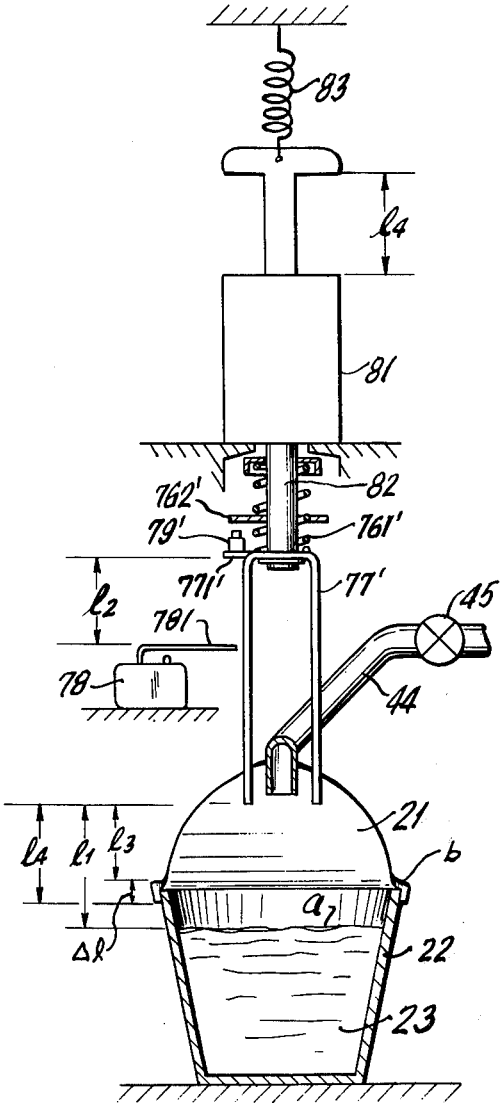
FIG. 9 is a sectional view of a modified embodiment of the device in FIG. 8.

FIG. 9 shows a modification of a mechanism as in FIG. 8, in which, a solenoid 81 is employed for moving the detector member 77′ instead of the motor 71 in FIG. 8.

The detector member 77′ is supported at a lower end of a plunger 82 of the solenoid 81. The plunger 82 is hung by a spring 83 and extends downwardly through the solenoid 81 in which is fixedly disposed.

The detector member 77′ is urged downwardly by a spring 761′ and is slidably along the plunger 82 against the spring 761′.

Because the detector member 77′ is moved downwardly by energizing the solenoid 81 and is moved upwardly by restoration, such parts as cam plate 72, microswitch 73, slider 74, and guide 75 in FIG. 8 are not required. If each of distances indicated by $l_1$, $l_2$, $l_3$ and $l_4$ is determined similarly as distances indicated by same letters in FIG. 8, this modification operates similarly as the embodiment in FIG. 8.

Figure 10:
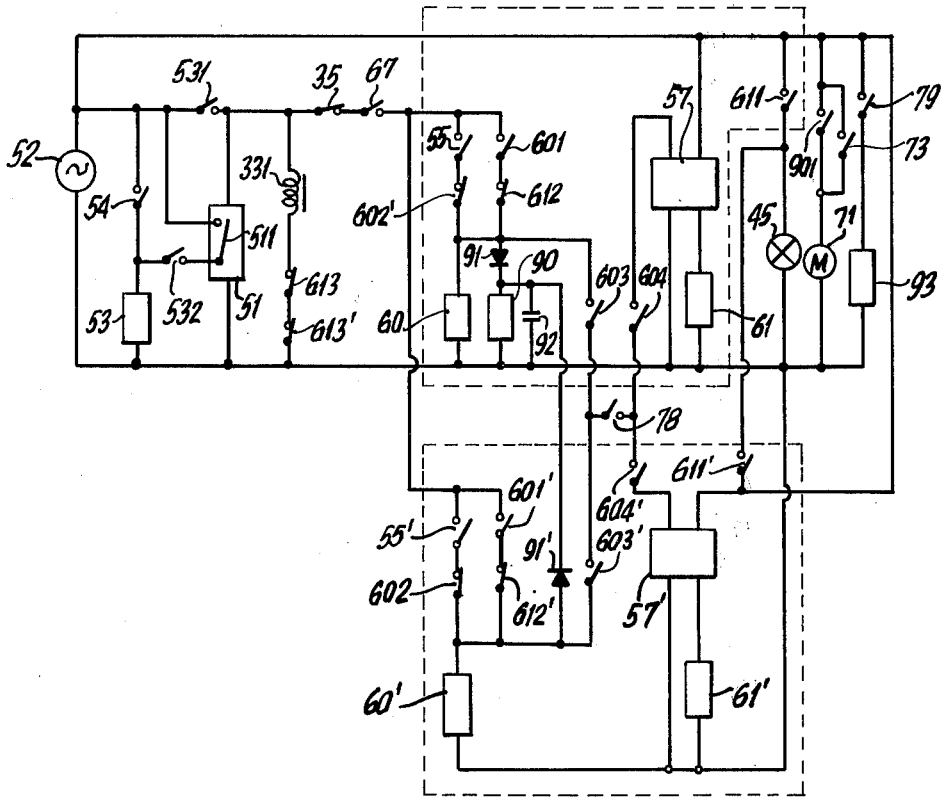
FIG. 10 is a circuit diagram of a control circuit of a cooking apparatus including devices shown in FIGS. 7 and 8.

FIG. 10 shows a control circuit which is similar to the circuit shown in FIG. 6 modified by the circuit in FIG. 6*a* but is also modified to provide for the arrangements shown in FIGS. 7 and 8.

Referring to FIG. 10, the use of two cook selective buttons is shown for the simplification of the drawing.

The difference of this control circuit from the circuit shown in FIG. 6, is the provision of the microswitch 67 as shown in FIG. 7 which is connected in series with the microswitch 35. Therefore, if the cup is not put in the cooking chamber 115 at the correct position, the following circuit components are maintained inoperable.

Another difference is that break contacts 613, 613′ of the relays 61 and 61′ are connected in series with the solenoid 331. Therefore the door 124 of the cooking chamber 115 is locked during a period when one of relays 61 and 61′ is activated permitting discharge of hot water into the cooking chamber 115.

A further difference is the addition of a control circuit of the motor 71 in FIG. 8. Namely, in order to drive the motor 71 when either switch contacts 55 or 55′ of cook selection buttons 125 is turned on, a common relay 90 is connected in parallel with the relays 60 and 60′ relay 90 has a make contact 901 which is connected between the power source 52 and the motor 71.

The microswitch 73 of FIG. 8 is connected in parallel with the make contact 901 so that the motor 71 is driven until a complete revolution of the cam plate 72 is completed to turn off the microswitch 73, even after the relay 90 is restored by the operation of the relay 61 or 61′.

The microswitch 78 in FIG. 8 is connected between the timers 57 and 57′ and relays 60 and 60′, so that each timer may be started by the closing of the microswitch 78. Accordingly, the electro-magnetic valve 45 is opened after it is detected that the cover 21 of the cup 22 is effectively removed.

Contacts 603, 604, 603′ and 604′ are make contacts of relays 60 and 60′, respectively and are provided for preventing timers corresponding to non-operated cook selection buttons from being started and for starting a timer corresponding to an operated cook selection button.

Diodes 91 and 91′ are provided for electrically isolating two relays 60 and 60′. A capacitor 92 is provided for maintaining the relay in operation during each negative half cycle of the AC power.

A buzzer 93 is connected to the power source 52 in series with the microswitch 79 in FIG. 8, to provide an alarm when the cover 21 of the cup 22 is not effectively removed.

According to the control circuit in FIG. 10, the motor 71 is continuously driven until a complete revolution of the cam plate 72 in FIG. 8 has been performed. Therefore, hot water will be discharged during a time period when the detector rod 77 in FIG. 8 is moving.

Figure 11:
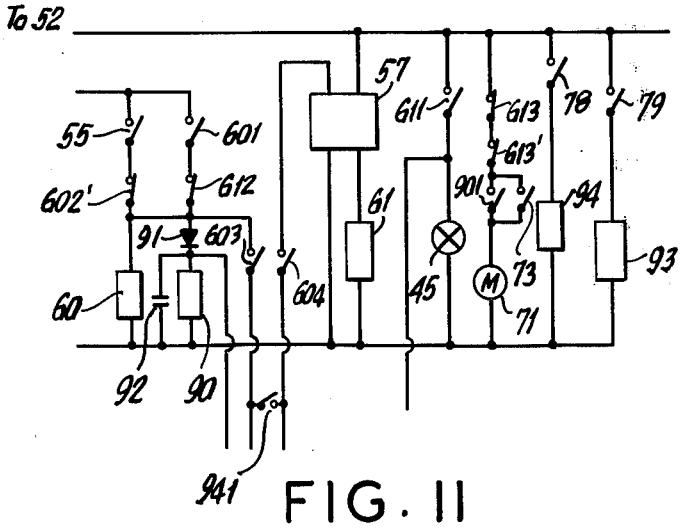
FIG. 11 is a circuit diagram of a main part of a modified one of the control circuit in FIG. 10.

FIG. 11 shows a modification of the circuit diagram of FIG. 10 for stopping the motor 71 during a time period when hot water is being discharged from the port 46 of the outlet pipe 44 (FIG. 8). For the simplification of the drawing, only the modified portion is only shown.

Namely, break contacts 613 and 613′ of relays 61 and 61′ are connected between the power source 52 and the microswitch 73. As a result, when the relay 61 is energized, the motor 71 is stopped. The microswitch 78 is connected between a relay 94 and the power source 52 to energize the relay 94 when the detector rod 77 (in FIG. 8) is lowered at the lowest position. The relay 94 is of a type which operates for a short period when energized. A make contact 941 of the relay 94 is connected between each timer 57 and each relay 60, instead of the microswitch 78 as shown in the embodiment of FIG. 10.

According to FIG. 11, it will be noted that hot water is discharged during a time period when the detector rod 77 is stopped at the lowest position. The rod 77 is returned to the initial rest position, after the discharge of hot water is performed.

When the alternate embodiment of FIG. 9 is employed rather then the arrangement of FIG. 8, the control circuit of FIG. 10 is so modified that the motor 71 in FIG. 10 is replaced by the solenoid 81 of FIG. 9. And the microswitch 73 in FIG. 10 is omitted. With this arrangement the discharge of hot water is performed after it is detected that the cover 21 of the cup is effectively removed. Specific examples of a cooking device and a previous motion device which is activated before cooking have been described, but various cooking devices and various previous motion devices may be also employed in the use of a control circuit which is similar to the circuit shown in FIG. 11. A generalized circuit arrangement of such a control circuit is shown in FIG. 12.

Figure 12:
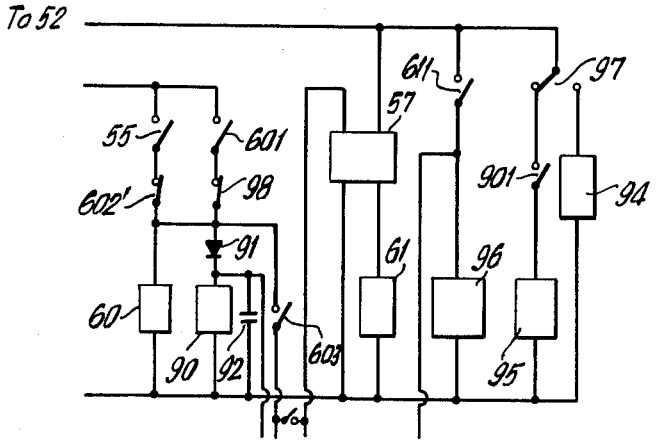
FIG. 12 is a fundamental circuit diagram of a main part of a control circuit of the cooking apparatus.

Referring to FIG. 12, similar parts are indicated by the same reference numerals as in FIG. 11. A previous motion device 95 is driven when any one of cook selection buttons 125 is operated and when the make contact 901 of the relay 90 is closed.

The relay 90, the capacitor 92 and diodes 91, are provided to control a common previous motion device 95 by operating any one of a plurality of cook selective buttons. Accordingly, these are not required to be used if a single cook selection, or start, button is employed. In such a case, the make contact 901 is replaced by a make contact of the relay 60.

When the motion of the device 95 is completed, the device 95 is stopped by the operation of a switch 97. The switch 97 is for detecting the completion of the motion of the device 95 and also detecting the completion of a cooking device 96.

The relay 94 is operated when the switch 97 is operated, so that the make contact of the relay is closed temporarily. As a result, the timer 57 is operated to maintain the relay 61 in operating condition during a predetermined time period. Therefore the cooking device 96 is energized through the make contact 611 of the relay and operates during the predetermined time period.

When the operation of the cooking device 96 is completed, the switch 97 is changed into a primary condition.

If the previous motion device 95 is one which is restored to the preliminary condition after the completion of the cooking cycle of device 96, the break contact 98 is designed to not as an operating contact of the relay 61 but rather as a switch contact such as a microswitch which is turned off by the restoration of the previous motion device 95. Alternatively, if the contact 98 is a break contact of the relay 61, a switch contact should be connected in parallel with the break contact 901 of the relay 90, which will be conductive until the previous motion device 95 is restored to the preliminary condition, this arrangement is shown by 73 in FIG. 11.

The previous motion device 95, may include a device for transferring the cup 22 to a cooking position, a device for perforating the cover 21 of the cup and such devices, besides the specific devices shown in FIGS. 8 and 9.

The cooking device 96 may include a device for vibrating the cup 22, a device for stirring the food in the cup, and a hot water feeding device.

Figure 13:
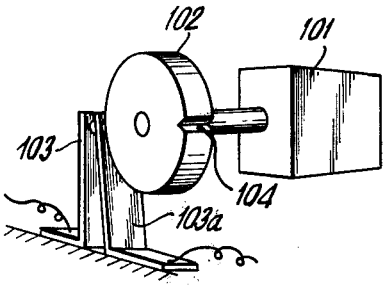
FIG. 13 shows a structure of an example of a timer which is used in this invention.

FIG. 13 shows an example of a timer which may be employed in above described embodiments, comprising an electric motor 101, a cam 102 which is rotated by the motor 101 and a switch contact 103 the on-off operation which is controlled by the cam 102.

A contact plate 103*a* of the switch contact 103 follows the cam 102, so that the switch contact 103 is turned off at a time when the contact plate 103*a* engages with a depression 104 of the cam 103. When the contact plate 103*a*, engages with the other cam surface, the switch contact 103 will conduct.

The contact plate 103*a* engages with the depression 104 when the timer is not operated. Once the timer is started by energizing the motor 101, the switch contact 103 is maintained on during a time period required for a complete revolution of the cam 102 and, is turned off when contact plate 103*a* again engages depression 104.

Accordingly, the operating time period of the timer is determined by the rotation rate of the cam 102.

Figure 13A:
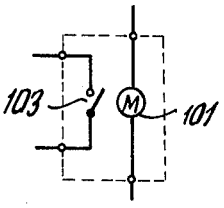
FIG. 13*a* shows an example of a circuit of the timer in FIG. 13.

FIG. 13*a* shows a circuit diagram of the timer in FIG. 13, when this timer is used as the timers 51 in FIGS. 6 and 10 and timers 57, 57′ and 57″ in FIG. 6.

Figure 13B:
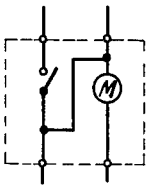
FIG. 13*b* shows another example of a circuit of the timer in FIG. 13.

FIG. 13*b* is a circuit diagram of the timer in FIG. 13, when the timer is used for timers 57, 57′ and 57″ in FIGS. 6*a*, 10, 11 and 12.

This invention is applicable to any automatic vending machines with cooking apparatus for various foods which are required to be cooked after vending.

This invention has been described in connection with specific embodiments. But it will be clearly understood this invention is not restricted to these specific embodiments and that various variations and modifications may be resorted to without departing from the spirit and scope of the invention.

What is claimed is:

1. In vending apparatus for dispensing foods having a vending control circuit which generates a vending signal when said foods are sold and a cooking apparatus for cooking the foods sold said cooking apparatus including a cooking chamber having a door to provide access to the chamber, a cooking device and manually operated switch means for activating the cooking device, an improvement comprising:

locking means for locking the door of the cooking chamber in a closed condition;

first detecting means for detecting said vending signal;

first timer means which is activated by said first detection means to operate during a first predetermined time period;

means for releasing said locking means in response to an output from said first timer means;

a second timer means connected to said output of said first timer means through said manually operated switch means, said second timer means being activated in response to the operation of said manually operated switch means during said first predetermined time period when said first timer means is in operation, and operating during a second predetermined time period, which is shorter than said first predetermined time period; and said cooking device being connected to the output from said second timer to be operated during said second predetermined time period.

2. The improvement as claimed in claim 1 including a power source and in which a first relay is connected in parallel with said first timer and in which said first detecting means includes a microswitch connected between said first relay and said power source, said first microswitch being closed in response to said vending control signal to energize said first relay which in turn activates said first timer.

3. The improvement as claimed in claim 1, including second detecting means for detecting that said door is open, said second detecting means controlling said second timer to prevent said second timer from activating when said door is open, in which said second detecting means includes a microswitch which is connected between said first and second timers, said microswitch being mounted adjacent to said door and having an activating arm extending outwardly therefrom, and an arm connected to and extending outwardly from said door to a point adjacent to said microswitch when said door is closed and said arm being arranged to move into contact with said activating arm and open said microswitch when said door is opened.

4. The improvement as claimed in claim 1 in which said vending apparatus dispenses said foods in a container and second detecting means for detecting that a food container is in said cooking chamber, said second detection means controlling said second timer to prevent said second timer from activating unless a food container is in said cooking chamber, said second detecting means including a microswitch which is connected between said first and said second timers, said microswitch having an activating member extending within said cooking chamber so that said member is contacted by a food container placed within said cooking chamber to close said microswitch permitting the activation of said second timer.

5. The improvement as claimed in claim 1, in which said cooking device includes a source of heated water, a pipe connecting said source of heated water to said cooking chamber and valve means connected to said pipe said valves means being controlled by said second timer means so that heated water flows through said pipe only during said second predetermined time period.

6. The improvement as claimed in claim 1, in which said locking means includes a solenoid and a plunger which is movable within said solenoid in response to energizing said solenoid from a first to a second predetermined position, a locking member extending outwardly from said door and having a aperture therein which is arranged to mate with said plunger when said plunger is in said first predetermined position to lock said door, means responsive to the activation of said first timer to energize said solenoid causing said plunger to move from said first to second predetermined position out of said aperture in said locking member to unlock said door.

7. The improvement as claimed in claim 6, including first bias means to cause said plunger to move from said second to said first predetermined position when said solenoid is deenergized when said first timer is deactivated.

8. The improvement as claimed in claim 1, in which said second timer means includes at least one second timer and said manually operated switch means includes at least one manually operated switch, and including a power source and at least one cooking control circuit, said cooking control circuit including a second relay connected in parallel with said second timer and said manually controlled switch connected between said power source and said second relay, said second relay being energized in response to the closing of said manually operated switch to activate said second timer.

9. The improvement as claimed in claim 8, including a plurality of said cooking control circuits and further including inhibiting means to inhibit the operation of all other said cooking control circuits when one second relay in one such cooking control circuit is energized.

10. The improvement as claimed in claim 9, in which said inhibiting means includes a break contact of said one second relay in series with the second relays of each of said other cooking control circuits.

11. The improvement as claimed in claim 8, including a plurality of said cooking control circuit, each of which includes a second timer and each of said second timers operating during a different predetermined time period.

12. An improvement as claimed in claim 1, in which said vending apparatus dispenses said foods in containers and including indexing means to insure that said containers are placed in a predetermined position within said cooking chamber.

13. An improvement as claimed in claim 12, in which each of said containers has an arcuate exterior surface having a predetermined maximum radius and in which said indexing means includes a guide having an arcuate guide surface having a radius greater than said predetermined maximum radius, said guide surface being mounted within said cooking chamber, a pivotally mounted movable arm extending into said cooking chamber to contact a container placed in said cooking chamber and bias means to cause said movable arm to move in a predetermined direction to urge said container into contact with said guide surface.

14. An improvement as claimed in claim 13, including second detecting means responsive to the position of said movable arm to detect the correct positioning of said containers within said cooking chamber.

15. An improvement as claimed in claim 1, in which said vending apparatus dispenses said foods in containers having removable covers and in which second detecting means are provided to detect that said covers are removed when said containers are positioned within said cooking chamber, said second detecting means being connected to said first timer through said manually operated switch means and said second detecting means being activated when said manually operated switch means are closed during said first predetermined time period when said first timer is activated and said second detecting means including a switch which is closed when said second detecting means detects that said cover is removed, said switch being connected between said first timer and said second timer means so that said second timer means is activated only when said second detecting means detects that said cover is removed.

16. An improvement as claimed in claim 15, in which said second detecting means further includes:

a movable tubular member having a longitudinal axis substantially perpendicular to the plane defining the top of said container when said container is positioned within said cooking chamber, a first end of said tubular member being spaced at first predetermined distance from said plane;

means to move said tubular member in a direction parallel to said axis a distance greater than said first predetermined distance;

an activating member projecting outwardly from the outer surface of said tubular member;

said switch being a microswitch having an activating lever, said activating lever extending to a point adjacent to said tubular member and disposed to be engaged by said activating member when said tubular member has moved a distance greater than said first predetermined distance closing said microswitch.

17. An improvement as claimed in claim 16, including third detecting means to detect if said tubular member encounters an obstacle prior to moving a distance greater than said first predetermined distance.

18. An improvement as claimed in claim 17, including alarm means activated by said third detecting means.

* * * * *